United States Patent [19]

Kobayashi

[11] Patent Number: 4,787,638

[45] Date of Patent: Nov. 29, 1988

[54] GOLF BALL

[75] Inventor: Masashi Kobayashi, Matsudo, Japan

[73] Assignee: Maruman Golf Co., Ltd., Tokyo, Japan

[21] Appl. No.: 8,888

[22] Filed: Jan. 30, 1987

[30] Foreign Application Priority Data

Jan. 31, 1986 [JP] Japan ..... 61-11718[U]

[51] Int. Cl.[4] ..... A63B 37/14

[52] U.S. Cl. ..... 273/232; 40/327

[58] Field of Search ..... 273/232, 235 A, 213, 273/183 C, 235 R, 235 B; 40/327

[56] References Cited

U.S. PATENT DOCUMENTS 1,418,220 5/1922 White ..... 273/232

2,939,710 6/1960 Dosmann et al. ..... 273/235 A

FOREIGN PATENT DOCUMENTS 171528 11/1921 United Kingdom ..... 273/232

*Primary Examiner*—George J. Marlo

*Attorney, Agent, or Firm*—Armstrong, Nikaido, Marmelstein & Kubovcik

[57] ABSTRACT

A golf ball comprises a body having a spherical outer surface and a plurality of first dimples arranged substantially uniformly in the spherical outer surface thereof. The body also has a plurality of indentations which are smaller than the first dimples and arranged substantially uniformly in the spherical outer surface and the inside surface of the first dimples. The indentations may be formed by grit blasting.

6 Claims, 3 Drawing Sheets

GOLF BALL

BACKGROUND OF THE INVENTION

1. Field of the Invention

The present invention relates to a golf ball and, more particularly, to an improvement of the aerodynamic characteristics of the outer surface of a golf ball having a plurality of dimples formed in the outer surface of the ball.

2. Disclosure of Related Art

Generally, a golf ball flying in the air is subject to two types of air resistance, i.e., a pressure drag produced by an air pressure difference produced in front of and behind the ball, and a friction drag produced by friction between the surface of the ball and the air. These resistances decrease the distance of flight of the ball. Generally, the friction drag imposed on the ball during flight is much less than the pressure drag imposed on the ball during flight. Therefore, to increase the distance of flight of the ball, it is desirable to reduce the pressure drag imposed on the ball, as much as possible.

When a ball is flying in the air, a laminar air flow boundary layer is produced on the front side of the ball, and a turbulent air flow boundary layer, i.e., an intermediate boundary layer at the point of transition from a laminar flow to a turbulent flow, is produced on the outer surface of the ball behind the laminar air flow boundary layer, and at the rear end of the turbulent air flow boundary layer, the air stream is exfoliated from the outer surface of the ball and a plurality of swirling streams are produced behind the ball. In front of the ball, air is pressurized by the ball, and thus the air pressure is increased, but behind the ball, the air pressure is reduced due to the exfoliation of the air stream from the outer surface of the ball. Therefore, a pressure difference occurs in front of and behind the ball during the flight, and accordingly, a resistance force is produced by this pressure difference which acts on the ball to disturb the advance of the ball. Such a resistance force is known as pressure drag. It is known that the magnitude of the pressure drag imposed on the ball during flight is roughly in proportion to the square of a kinetic speed of the ball.

In order to reduce the pressure drag imposed on the golf ball during the flight, it is desirable to reduce the air pressure difference produced in front of and behind the ball as soon as possible by reducing the pressure drop produced behind the ball. Accordingly, it is desirable to improve the aerodynamic characteristics of the outer surface of the ball so that the turbulent air flow boundary layer extends toward the front and back of the ball, and the exfoliating point of the air stream shifts toward the back of the ball.

In conventional golf balls, a spherical body is formed with a plurality of circular dimples uniformly arranged in the entire outer surface thereof. These dimples serve to shift the exfoliating point of the air stream toward the back of the ball.

When the relationship between the kinetic speed of the golf ball and the air pressure drag imposed on the ball during flight is examined, the air pressure drag imposed on the ball increases gradually in accordance with the increase of the ball speed, but immediately after the ball speed exceeds a certain speed, i.e., a critical speed, the air pressure drag is abruptly reduced, and then the pressure drag also increases gradually in accordance with the increase of the ball speed. Such an abrupt decrease of the pressure drag occurs due to the production of a turbulent air flow boundary layer on the outer surface of the ball. Generally, the kinetic speed of a golf ball hit by a golf club is in a range of 20 to 70 m/sec: an initial speed of the ball being in a range of 40 to 70 m/sec; and the speed of the ball during falling being in a range of 20 to 30 m/sec. When a golf ball having a smooth spherical outer surface without dimples is hit by a golf club, an abrupt drop of a pressure drag due to a production of a turbulent air flow boundary layer occurs at a speed of about 60 m/sec. That is, a critical speed of a ball having a smooth outer surface is about 60 m/sec. Therefore, such a ball having a smooth outer surface is subject to a small pressure drag during flight at a high speed of 60 to 70 m/sec, but is subject to a greater pressure drag during flight at a low and medium speed of 20 to 60 m/sec, resulting in a decrease of the distance of flight of the ball and a deterioration of directional control of the flight of the ball. In the case of a conventional golf ball having dimples on the outer surface thereof, a critical speed is about 25 to 30 m/sec. Therefore, such a ball having dimples is subject to a small pressure drag during flight at the medium and high speeds, but is subject to a greater pressure drag during flight at the low speed, particularly when the ball falls, resulting in a decrease of the distance of flight of the ball.

SUMMARY OF THE INVENTION

An object of the present invention is to provide a golf ball which can increase a distance of flight thereof and improve a directional control of the flight thereof.

Another object of the present invention is to reduce a critical speed of the golf ball and a pressure drag imposed on the golf ball during flight.

According to the present invention, there is provided a golf ball comprising a body having a spherical outer surface and a plurality of first dimples arranged substantially uniformly in the spherical outer surface, the body also having a plurality of second fine dimples which are smaller than the first dimples and arranged substantially uniformly in the spherical outer surface and the inside surface of the first dimples.

In the golf ball according to the present invention, a turbulent air flow boundary layer can be easily produced on the outer surface of the ball during flight due to the existence of the second fine dimples (or indentations), in the spherical outer surface and the inside surface of the first dimples. Therefore, the critical speed of the golf ball according to the present invention can be reduced to less than that of a conventional golf ball having dimples due to earlier projection of the turbulent air flow boundary layer, and after the ball speed exceeds the critical speed, the magnitude of the pressure drag imposed on the golf ball according to the present invention can be reduced to less than that of the conventional golf ball having dimples, due to a broader projection of the turbulent air flow boundary layer on the outer surface of the ball. As a result, a distance of flight of the ball according to the present invention can be increased to more than that of the conventional golf ball having dimples, and a directional control of the flight thereof can be improved.

Preferably, the second fine dimples according to the present invention are formed in the spherical outer surface and the inside surface of the body of the golf ball by grit blasting.

The foregoing and other objects and advantages of the present invention will be better understood from the following description with reference to the preferred embodiments illustrated in the drawings.

DESCRIPTION OF THE PREFERRED EMBODIMENTS

Figure 1:
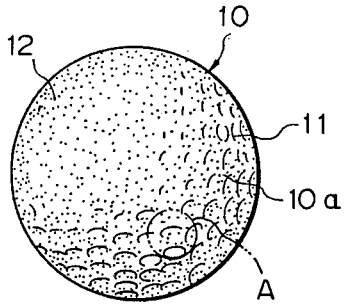
FIG. 1 is a front view of a golf ball illustrating a preferred embodiment of the present invention.
Figure 2:
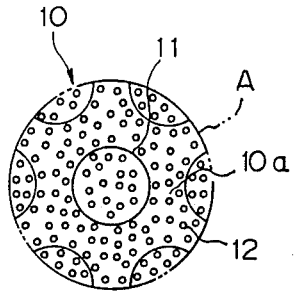
FIG. 2 is a schematical enlarged view of a part A of the surface of the ball shown in FIG. 1.
Figure 3:
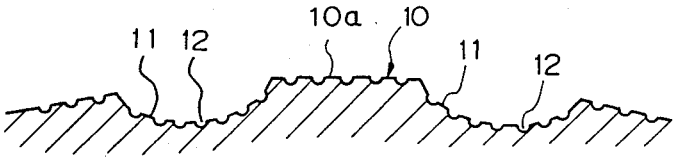
FIG. 3 is an enlarged cross-sectional view of a part of the ball shown in FIG. 1.

FIGS. 1 to 3 show a preferred embodiment of the present invention. Referring to these Figures, a golf ball has a spherical body 10 having a spherical outer surface 10*a* and a plurality of first circular dimples 11 arranged substantially uniformly in the outer surface 10*a*. The first dimples 11 have the same or similar shapes as those of conventional balls having dimples. Each of the first dimples 11 may have a form of double dimples, as known in conventional golf balls. According to the present invention, a plurality of second fine dimples (or indentations) 12, which are smaller than the first dimples 11, are arranged in the outer surface 10*a* and the inside surface of the first dimples 11 of the body 10, as apparent from FIGS. 2 and 3. Preferably, the second fine dimples (or indentations) 12 are formed by grit blasting with particles of sand or glass. The second fine dimples (or indentations) 12 may be formed together with the first dimples 11 by a mold.

In the golf ball according to the present invention, a turbulent air flow boundary layer can be easily produced on the outer surface of the ball during flight due to the existence of the second fine dimples (or indentations) 12 in the spherical outer surface 10*a* and the inside surface of the first dimples 11. Therefore, the critical speed of the golf ball according to the present invention can be reduced to less than that of a conventional golf ball having dimples, due to earlier projection of the turbulent air flow boundary layer, and after the ball speed exceeds the critical speed, the magnitude of the pressure drag imposed on the golf ball according to the present invention can be reduced to less than that of the conventional golf ball having dimples, due to broader projection of the turbulent air flow boundary layer on the outer surface of the ball.

Figure 4:
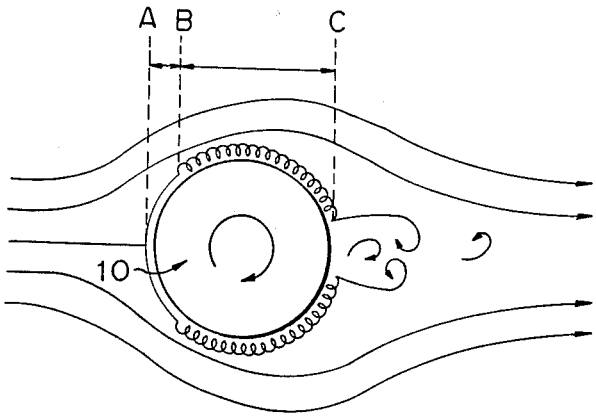
FIG. 4 is a schematical view illustrating the state of air streams produced around the ball shown in FIG. 1 during flight.
Figure 5:
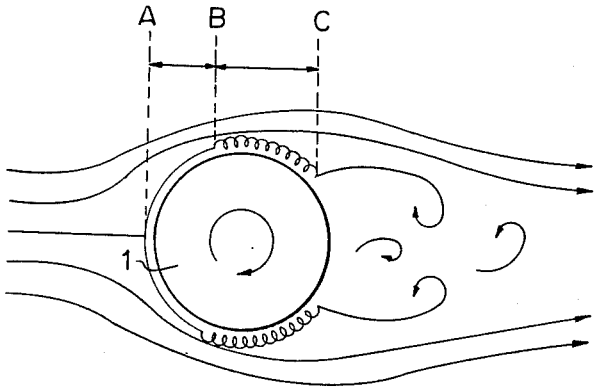
Fig. 5 PRIOR ART
FIG. 5 is a schematical view illustrating the state of air streams produced around a conventional ball having dimples, during flight.

FIG. 4 schematically shows a state of air streams produced around the above-mentioned ball according to the present invention during flight at a certain speed higher than a critical speed, and FIG. 5 schematically shows a state of air streams produced around a conventional golf ball 1 having dimples (not shown) during the flight at the same speed as that of the ball shown in FIG. 4. The ball shown in FIG. 4 is different from the conventional ball shown in FIG. 5 only in the point that the second fine dimples are formed in the spherical outer surface and the inside surface of the first dimples. In both cases shown in FIGS. 4 and 5, a laminar air flow boundary layer is produced on the outer surface of the ball within a first region of from a point A to a point B, and a turbulent air flow boundary layer is produced on the outer surface of the ball within a second region of from the point B to a point C, and at the point C, the air stream is exfoliated from the outer surface of the ball. However, in the case of the ball according to the present invention, the turbulent air flow boundary layer is extended toward the front and back of the ball, and thus the exfoliating point C of the air stream is shifted toward the back of the ball, as apparent from the comparison of the states of air streams shown in FIGS. 4 and 5. Therefore, in the case of the ball according to the present invention, a subatmospheric pressure produced in a region behind the ball due to the exfoliation of the air stream is reduced, and thus an air pressure difference produced in front of and behind the ball is reduced. Accordingly, a pressure drag imposed on the ball is particularly reduced when the ball speed is higher than the critical speed.

Figure 6:
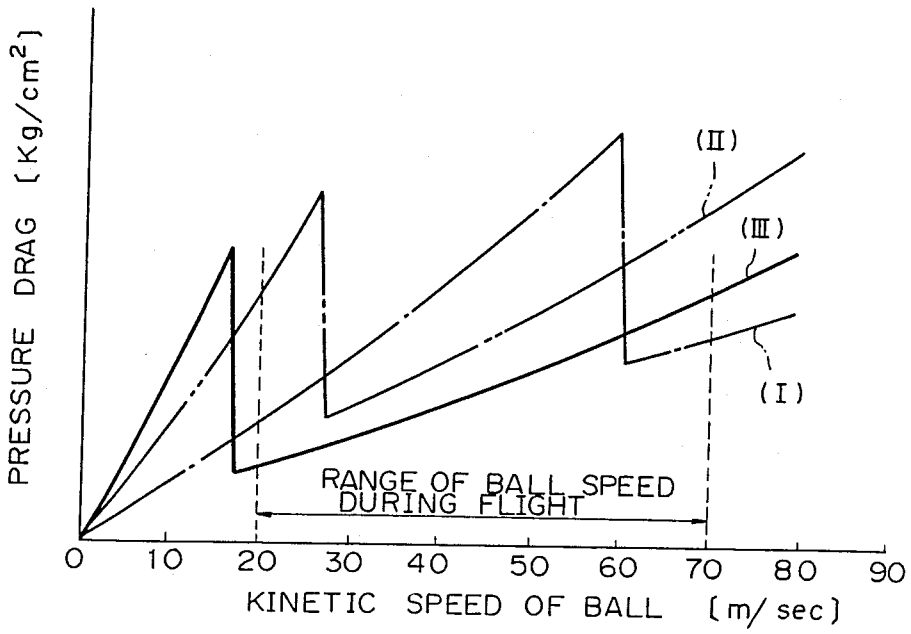
FIG. 6 is a graph illustrating a relationship between a kinetic speed of a ball and an air pressure drag imposed on the golf ball during flight.

FIG. 6 shows three types of relationship between the ball speed and the pressure drag imposed on the golf ball during flight. In the case of the conventional golf ball having an even outer surface, as indicated by a one-dot line denoted by reference character (I), the critical speed is about 60 m/sec, and in the case of the conventional golf ball having conventional dimples, as indicated by a two-dot line denoted by reference character (II), the critical speed is about 27 m/sec. In contrast, in the case of the golf ball according to the present invention, as indicated by a solid line denoted by reference character (III), the critical speed is about 17 m/sec. Since an ordinary ball speed obtained by an ordinary club swing is in the range of 20 to 70 m/sec, the critical speed obtained by the ball according to the present invention is less than the ordinary minimum ball speed of 20 m/sec. Therefore, the ball according to the present invention can be moved by an ordinary swing at a speed which is higher than the critical speed, under a small pressure drag. As apparent from FIG. 6, the pressure drag imposed on the golf ball according to the present invention after the ball speed exceeds the critical speed is kept smaller than those imposed on the conventional balls. As a result, the golf ball according to the present invention can increase the distance of flight and improve the directional control of the flight.

I claim:

1. A golf ball, comprising:

a body having a generally spherical outer surface;

a plurality of dimples disposed substantially uniformly on said spherical outer surface; and a plurality of indentations, smaller than said dimples, formed in each dimple and on the spherical outer surface.

2. The golf ball of claim 1, wherein said indentations in said dimples and on said spherical outer surface have structural characteristics corresponding to indentations formed by grit blasting.

3. The golf ball of claim 1, wherein each of said dimples has a hemispherical wall.

4. The golf ball of claim 3, wherein each of said indentations has a hemispherical wall.

5. The golf ball of claim 1, wherein each of said indentations has a hemispherical wall.

6. The golf ball of claim 1, wherein the parameters of said indentations are such that said indentations actively generate small vortices of air on each dimple and on said spherical outer surface during flight of the ball.

* * * * *